US006247918B1

(12) United States Patent
Forbes et al.

(10) Patent No.: US 6,247,918 B1
(45) Date of Patent: Jun. 19, 2001

(54) FLAME MONITORING METHODS AND APPARATUS

(75) Inventors: Stewart Forbes, Reading; Brian Powell, Maidenhead, both of (GB)

(73) Assignee: Forney Corporation, Carrollton, TX (US)

( * ) Notice: Subject to any disclaimer, the term of this patent is extended or adjusted under 35 U.S.C. 154(b) by 0 days.

(21) Appl. No.: 09/438,781

(22) Filed: Nov. 12, 1999

(30) Foreign Application Priority Data

Dec. 16, 1998 (GB) ..... 9827719

(51) Int. Cl.[7] ..... F23N 5/00
(52) U.S. Cl. ..... 431/12; 431/79; 431/76
(58) Field of Search ..... 431/12, 76, 79, 431/75

(56) References Cited

U.S. PATENT DOCUMENTS 4,709,155 * 11/1987 Yamaguchi et al. ..... 431/79
4,913,647 * 4/1990 Bonne et al. ..... 431/12
5,077,550 * 12/1991 Cormier ..... 431/79
5,249,954 * 10/1993 Allen et al. ..... 431/76
5,332,386 * 7/1994 Hosome et al. ..... 431/12
5,495,112 * 2/1996 Maloney et al. ..... 431/79
5,599,179 * 2/1997 Lindner et al. ..... 431/12
5,785,512 * 7/1998 Cormier ..... 431/12
5,798,946 * 8/1998 Khesin ..... 431/12
5,961,314 * 10/1999 Myhre et al. ..... 431/79
5,971,747 * 10/1999 Lemelson et al. ..... 431/12
5,993,194 * 11/1999 Lemelson et al. ..... 431/76
6,045,353 * 4/2000 VonDrasek et al. ..... 431/12
6,071,114 * 6/2000 Cusack et al. ..... 431/79

* cited by examiner

*Primary Examiner*—Ira S. Lazarus
*Assistant Examiner*—Josiah C. Cocks
(74) *Attorney, Agent, or Firm*—Locke Liddell & Sapp LLP

(57) ABSTRACT

In an apparatus for monitoring a hydrocarbon flame, a plurality of radiation sensors detect electromagnetic radiation emitted by the flame. Each of the sensors is provided with a narrow band filter so that the corresponding sensor is responsive only to a narrow range of wavelengths. In this manner, one of the sensors is made responsive to emissions due to transient species in the flame and one of the sensors is made responsive to emissions from a non-transient species in the combustion region. The signals from the radiation sensors are converted to digital and applied to a central processing unit where they are compared to produce an output indicative of the combustion conditions in the flame. An output unit responds to the output signal from the central processing unit to adjust the air fuel ratio in the flame to a desired level, such as just above stoichiometric.

6 Claims, 8 Drawing Sheets

FLAME MONITORING METHODS AND APPARATUS

The invention relates to flame monitoring methods and apparatus. Flame monitoring apparatus embodying the invention, and to be described below by way of example only, may be used for monitoring a flame of burning hydrocarbon fuel such as in a boiler, furnace or other combustion equipment, in order to determine characteristics of the flame and, in particular, to provide information on the stoichiometry of the combustion process. In such an application, therefore, the apparatus can be used to improve combustion efficiency and reduce the production of pollutants.

According to the invention, there is provided apparatus for monitoring a hydrocarbon flame, comprising first detecting means responsive to electromagnetic radiation emitted by the flame in a first wavelength corresponding to transient species existing for only a short time within the combustion region of the flame to produce a first detection signal, second detecting means responsive to electromagnetic radiation emitted by the flame in a second wavelength corresponding to non-transient species in the combustion region to produce a second detection signal, and comparing means responsive to the first and second detection signals to produce a comparison signal, and output responsive to the comparison signal to produce an output signal dependent on the air/fuel ratio in the flame.

According to the invention, there is further provided a method for monitoring a hydrocarbon flame, comprising the steps of detecting electromagnetic radiation emitted by the flame in a first wavelength corresponding to a transient species existing for only a short time within the combustion region of the flame to produce a first detection signal, detecting electromagnetic radiation emitted by the flame in a second wavelength corresponding to a non-transient species in the combustion region to produce a second detection signal, comparing the first and second detection signals to produce a comparison signal, and responding to the comparison signal to produce an output signal dependent on the air/fuel ration in the flame.

Flame monitoring methods and apparatus according to the invention will now be described by way of example only, with reference to the accompanying diagrammatic drawings in which.

Figure 1:
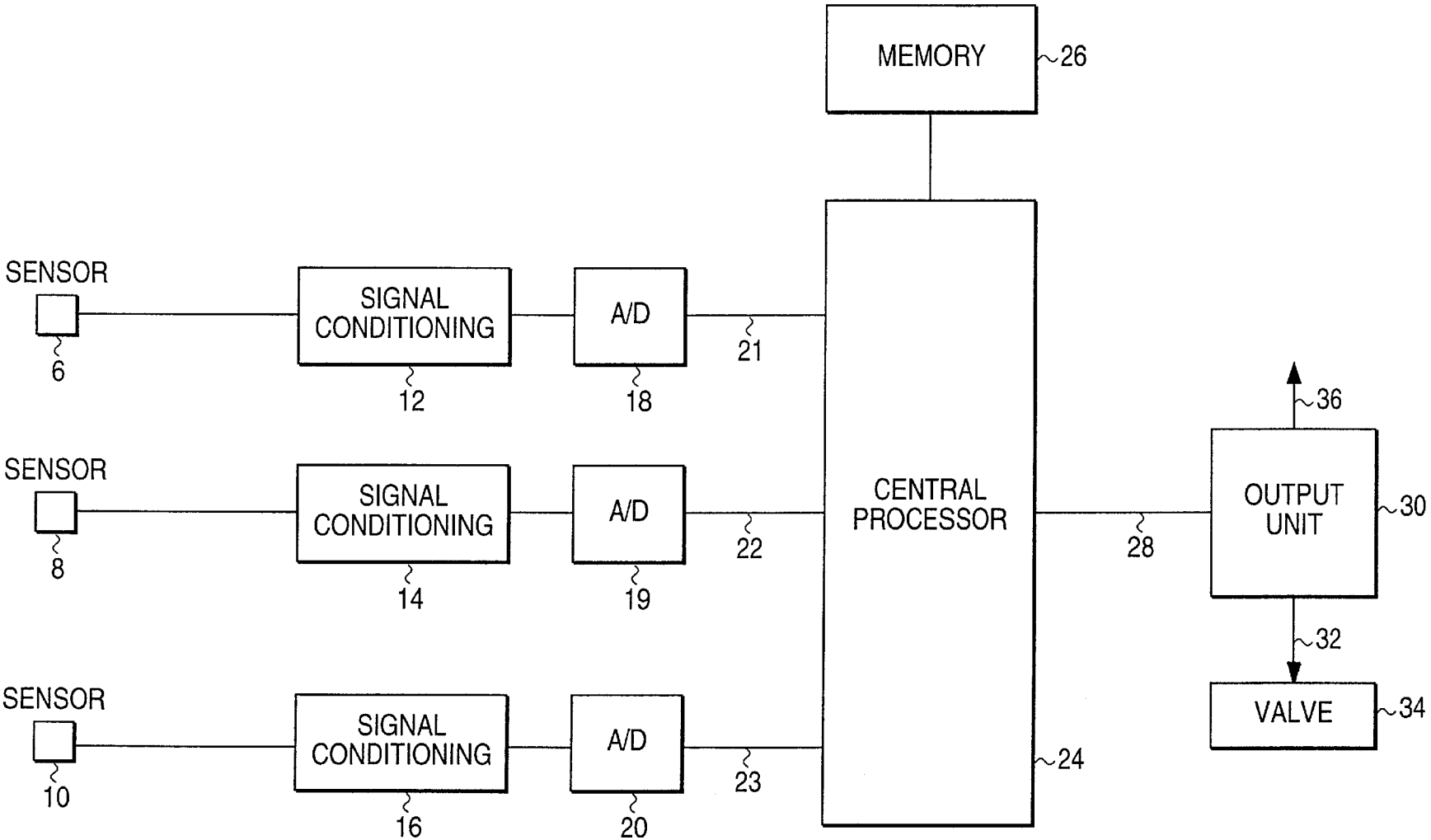
FIG. 1 is a block diagram of one form of the apparatus.

The apparatus shown in FIG. 1 comprises a plurality of electromagnetic radiation sensors. As will be explained in more detail below, there are at least two sensors and preferably three and possibly more. For ease of description, FIG. 1 shows three sensors, 6, 8 and 10. Each of these sensors is fitted with a narrow band filter so that it is only responsive to a narrow range of wavelengths in a particular band. These wavelengths and bands will be discussed in more detail below. The sensors are mounted in or on the boiler, furnace or other combustion apparatus and positioned to view the flame of burning hydrocarbon fuel which is to be monitored. The signals from each of the sensors, dependent on the radiation sensed in the respective narrow range of wavelengths, are amplified and frequency-band limited by a respective one of signal conditioning units 12, 14 and 16 and then passed to respective analog to digital converters 18, 19 and 20. The resultant digitized detection signals on lines 21, 22 and 23 are passed to a central processing unit 24. A memory 26 is associated with the CPU 24. In a manner to be explained in detail below, the CPU processes the data and provides information on the stoichiometry of the combustion process. The resultant output on a line 28 is passed to an output unit 30. The unit 30 can produce an output on a line 32 which automatically controls a valve arrangement shown diagrammatically at 34 which in turn can adjust the fuel/air ratio in the furnace, so as to produce the desired air/fuel ratio. This may be adjusted to the stoichiometric ratio, to maximize efficiency, or to a predetermined amount of excess air in order to reduce pollutants.

In addition, the output unit 30 can produce an output on a line 36 for indicating the results of the flame monitoring process on a suitable display and/or for transmitting the information to a distant location.

In one advantageous form of the apparatus, which will now be described in more detail, sensor 6 is arranged to be responsive to radiation in a narrow wavelength band centered at 2.96 $\mu$m, sensor 8 is arranged to be responsive to radiation in a narrow wavelength band centered at 3.35 $\mu$m, and sensor 10 is arranged to be responsive to radiation in a narrow wavelength band centered at 310 nm. In such an arrangement, sensors 6 and 8 can be lead selenide sensors, and sensor 10 can be a silicon sensor.

The operation of the apparatus will now be considered in more detail.

The emission spectrum of a hydrocarbon flame contains various emission peaks, examples of which are as follows:

(a) a peak associated with the hot hydrocarbon fuel in the flame, such as centered at 3.35 $\mu$m;

(b) peaks associated with products of combustion in the flame—such as centered at 927 nm, 1.45 $\mu$m and 2.9 $\mu$m for $H_2O$, and 4.5 $\mu$m for $CO_2$; and (c) peaks associated with transient species that only exist for a short time within the combustion region, such as a peak corresponding to OH centered at about 310 nm, a peak associated with CH centered at about 431 nm, and a peak associated with $C_2$ centered at about 517 nm.

It has been found in accordance with the invention that the frequency spectrum of emissions due to the transient species is significantly different from the frequency spectrum of the emissions due to the fuel and the products of combustion, and that these differences vary with the stoichiometry of the combustion process.

Figure 2:
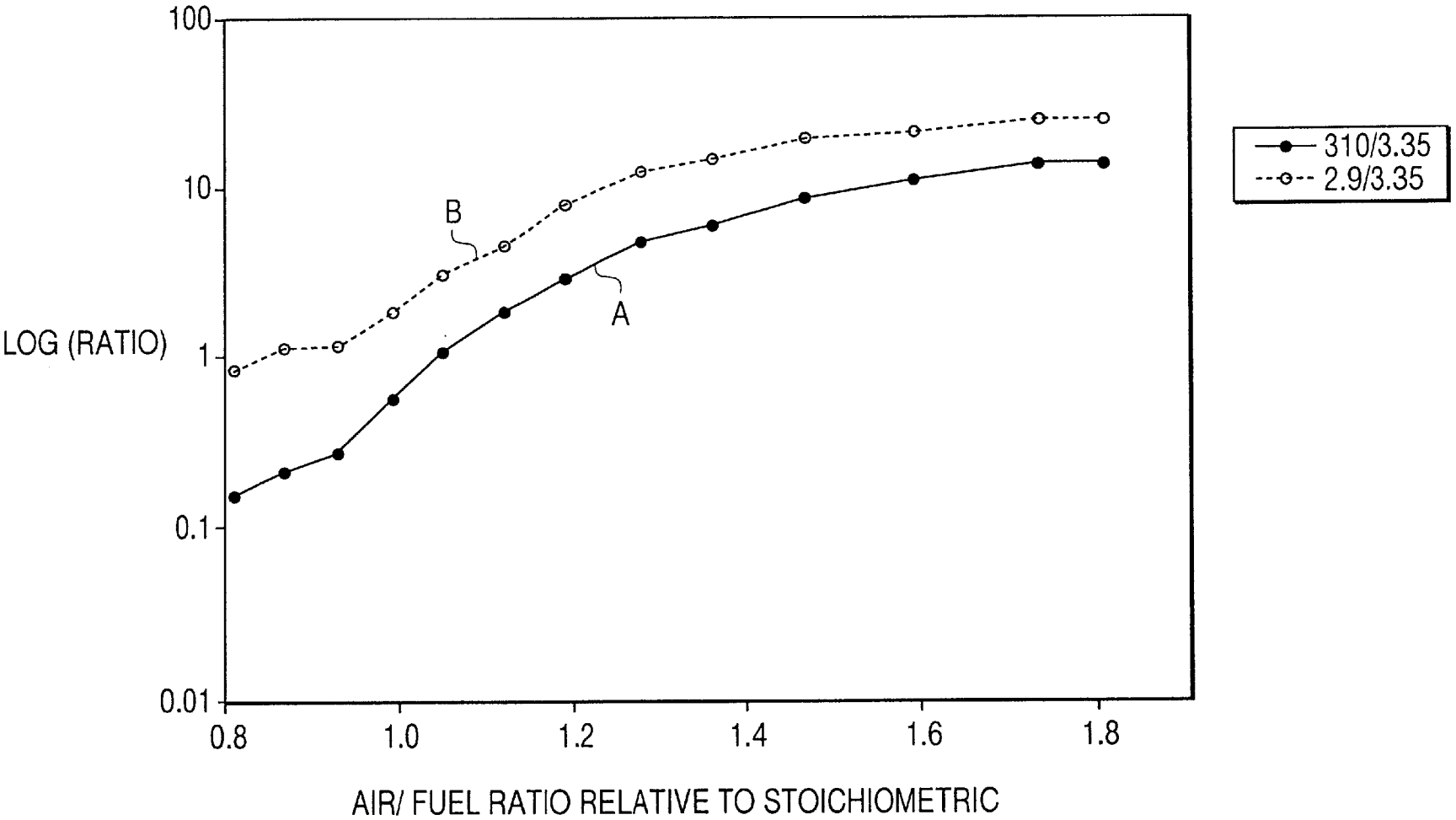
FIGS. 2–8 are graphs for explaining the operation of the apparatus of FIG. 1.

In FIG. 2, the vertical axis is the ratio of the power in a particular frequency band between two of the digitized detection signals (lines 18, 19 and 20), to a logarithmic scale, and the horizontal axis is the air/fuel ratio relative to the stoichiometric value (1). In FIG. 2, curve A represents the ratio of the power in a particular frequency band in the detection signal from sensor 10 (at 310 nm corresponding the to OH transient series) to the power in a particular frequency band in the detection signal from sensor 8 (at 3.35 $\mu$m corresponding to the emission from the hot hydrocarbon fuel). Curve B represents the ratio of the power in a particular frequency band in the detection signal from sensor 6 (at 2.9 $\mu$m, corresponding to $H_2O$) to the power in a particular frequency band in the detection signal from sensor 8 (at 3.35 $\mu$m corresponding to the hot hydrocarbon fuel). The curves in FIG. 2 were measured in a gas-fired furnace at 100% load (maximum fuel input), and were measured over a 10–30 Hz frequency band.

FIG. 2 clearly shows that curve A varies much more significantly with the air/fuel ratio than does curve B, particularly over the important region close to the stoichiometric air/fuel ratio. The curves thus show that the frequency spectrum of the emissions due to the transient species (OH in this case) is significantly different from the frequency spectrum of the fuel or product species emissions and that these differences vary with flame stoichiometry.

Figure 3:
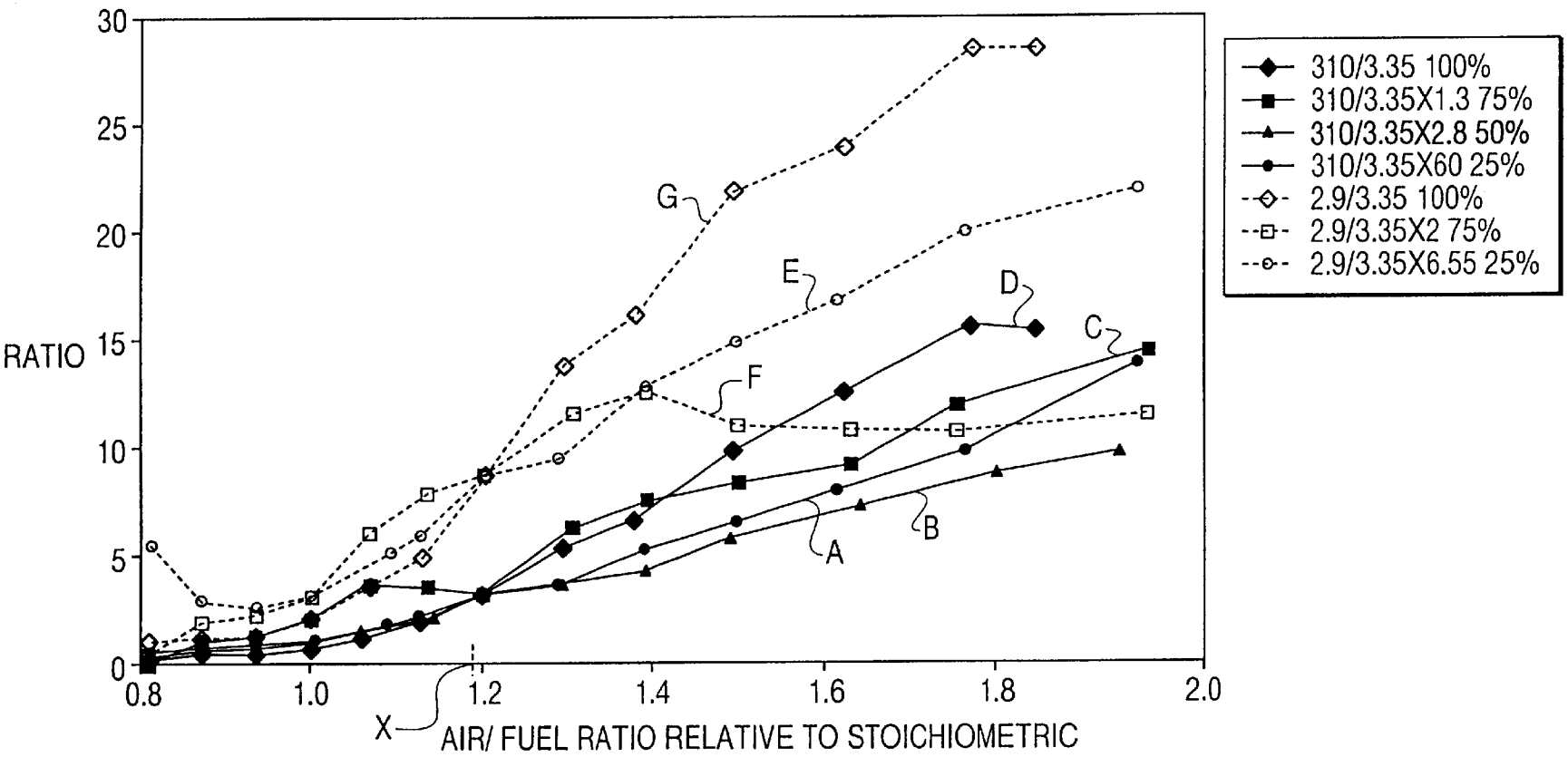

FIG. 3 corresponds to FIG. 2 (the axes are the same although the vertical axis is not to a logarithmic scale in FIG. 3), but shows curves at a range of different furnace loads or fuel inputs. The four curves shown in full line (curves A, B, C and D) all show the ratio of the power in a particular frequency band in the detection signal from a sensor 10 (at 310 nm corresponding to the OH transient species) to the power in a particular frequency band in the detection signal from sensor 8 (at 3.35 $\mu$m, corresponding to the hot fuel in the flame), curves A, B, C and D corresponding respectively to furnace loads or fuel inputs of 25%, 50%, 75% and 100% of the maximum.

The dotted curves E, F, and G all show the ratio of the power in a particular frequency band in the detection signal from sensor 6 at 2.9 $\mu$m (the $H_2O$ product) to the power in a particular frequency band in the detection signal from sensor 8 at 3.35 $\mu$m (the hot fuel in the flame). Curves E, F and G correspond respectively to the ratios at furnace loads or fuel inputs of 25%, 75% and 100% of the maximum.

In order to enable a comparison to be made between the different curves, the values corresponding to the 25%, 50% and 75% loads have been multiplied by arbitrary factors to make them equivalent to the ratio values at 100% load at an air/fuel ratio of 3% excess oxygen above stoichiometric (indicated at X).

FIG. 3 clearly shows that curves A, B, C and D (plotting the ratio of the signal due to the OH transient species output to the signal due to the hot fuel in the flame) have a much better consistency and a more systematic change with the air/fuel ratio at different furnace loads than curves E, F and G.

Accordingly, in one mode of operation, the apparatus of FIG. 1 uses the digitized detection signals on lines 18, 19 and 20 from the sensors 6, 8 and 10 to measure the two ratios discussed above: (i) the ratio of the power in a particular frequency band in the detection signal corresponding to the OH transient species at 310 nm to the detection signal corresponding to the emission from the hot fuel in the flame at 3.35 $\mu$m, and (ii) the ratio of the power in a particular frequency band in the detection signal corresponding to the $H_2O$ product at 2.9 $\mu$m to the power in a particular frequency band in the detection signal emission from the hot fuel in the flame at 3.35 $\mu$m. If the frequency passbands of the signal conditioning units 12, 14 and 16 are sufficiently narrow, the CPU 24 can determine these two ratios by measuring the mean amplitude in each detector signal and comparing them. Alternatively, if the frequency passbands of the signal conditioning units are relatively wide, the CPU can perform a Fast Fourier Transform on the digitized data, to convert it into the frequency domain, and then integrate over the required frequency band and again take the ratios. The resultant ratio data is then compared with data stored in the memory 26 (thus, in effect, using data corresponding to that shown in FIGS. 2 and 3) to determine the combustion conditions. The resultant signal on line 28 is then used by the output unit 30 to adjust the air/fuel ratio by means of the valve 34 to produce a desired air/fuel ratio (normally, just above stoichiometric).

Figure 4:
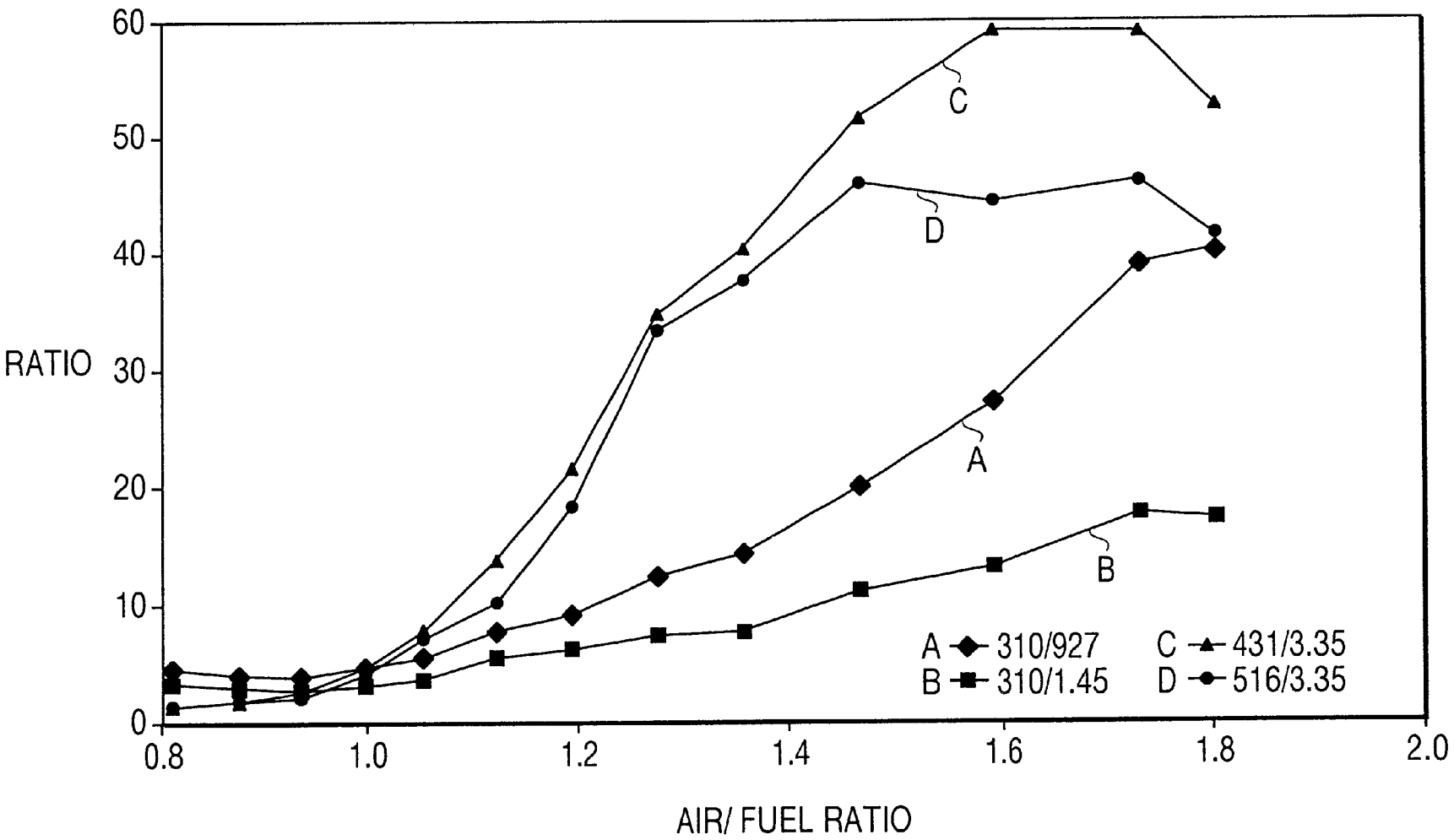

FIG. 4 is generally similar to FIG. 2 (except that the vertical scale is not logarithmic), but plots power ratios between outputs at different wavelengths. Thus, curve A in FIG. 4 shows the power ratio between the output at 310 $\mu$m (the OH transient species) and the output at 927 nm (corresponding to $H_2O$), plotted against the air/fuel ratio. Curve B shows the power ratio between the output at 310 nm (the OH transient species) and the output at 1.45 $\mu$m (again corresponding to $H_2O$), plotted against the air/fuel ratio. Curve C shows the power ratio between the output at 431 nm (the CH transient species) and the output at 3.35 $\mu$m (corresponding the hot fuel) plotted against the air/fuel ratio. Finally, curve D shows the power ratio between the output at 516 nm (the $C_2$ transient species) and the output at 3.35 $\mu$m (the hot fuel), plotted against the air/fuel ratio. The curves were all measured in a gas-fired furnace at full load. In each case, there is again shown a significant variation of the power ratio with the air/fuel ratio. Thus, FIG. 4 shows that the sensors 6, 8 and 10 (or one or two of them) can be modified to be sensitive to different radiation wavelengths so as to enable the CPU to measure one of the power ratios shown in FIG. 4 and—thereby measure the air/fuel ratio in the flame.

Curves generally similar in shape to Curves A, B, C and D in FIG. 4 will also be obtained if the non-transient species measured is $H_2O$ at 2.9 $\mu$m or is $CO_2$ at 4.5 $\mu$m.

FIGS. 5, 6, 7 and 8 show another mode of processing the data derived from the sensors 6, 8 and 10. In this mode, the detection signal data from the different detectors is correlated to derive the cross-correlation coefficient (vertical axis), and this is plotted against the air/fuel ratio relative to stoichiometric (horizontal axis).

Figure 5:
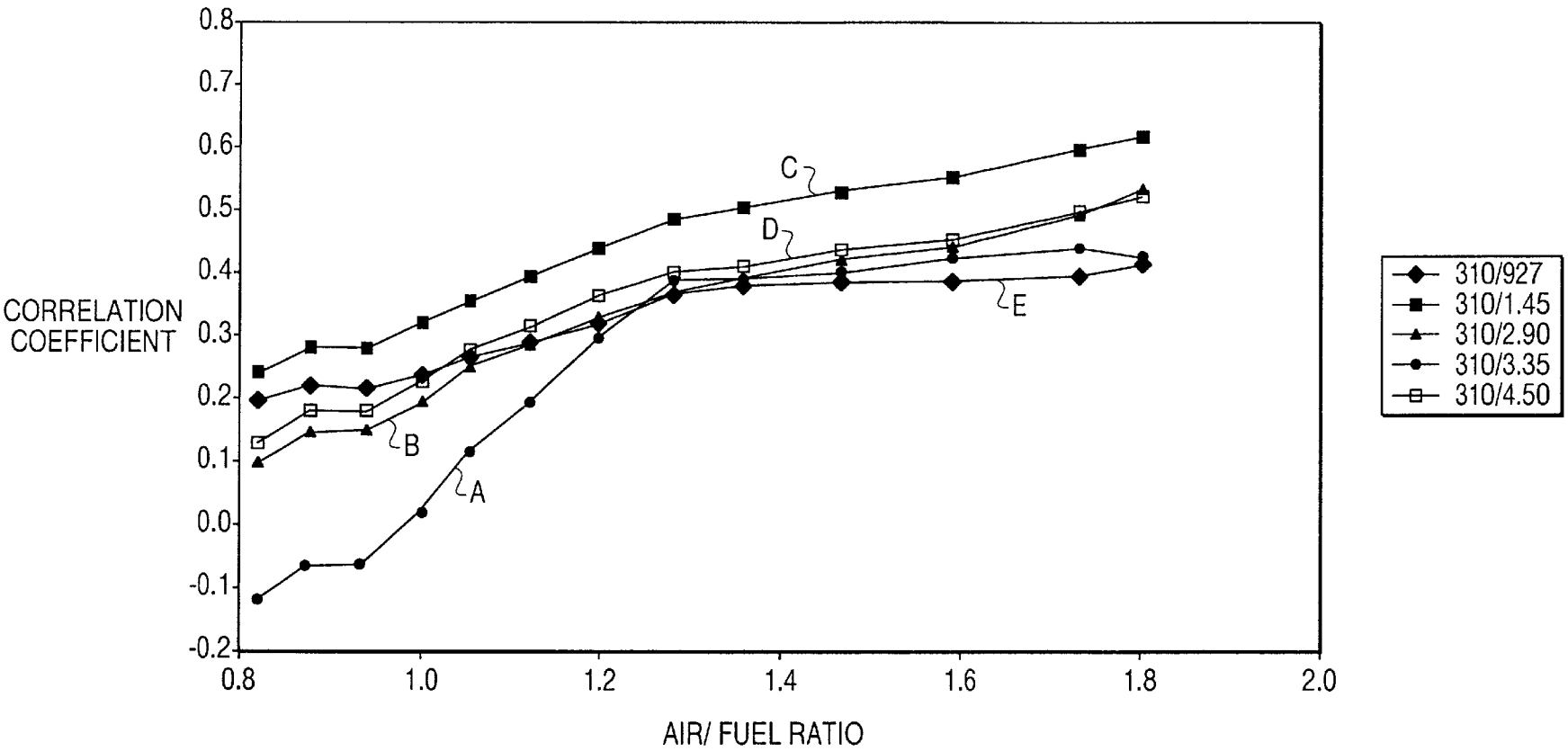

Thus, curve A in FIG. 5 shows how the cross-correlation coefficient between the detection signal at 310 nm corresponding to the OH transient species (sensor 10), and the detection signal at 3.35 $\mu$m corresponding to the hot fuel in the flame (sensor 8) varies with the air/fuel ratio. Curve A shows that there is a significant variation which is substantially linear over the important region adjacent to the stoichiometric ratio.

Figure 8:
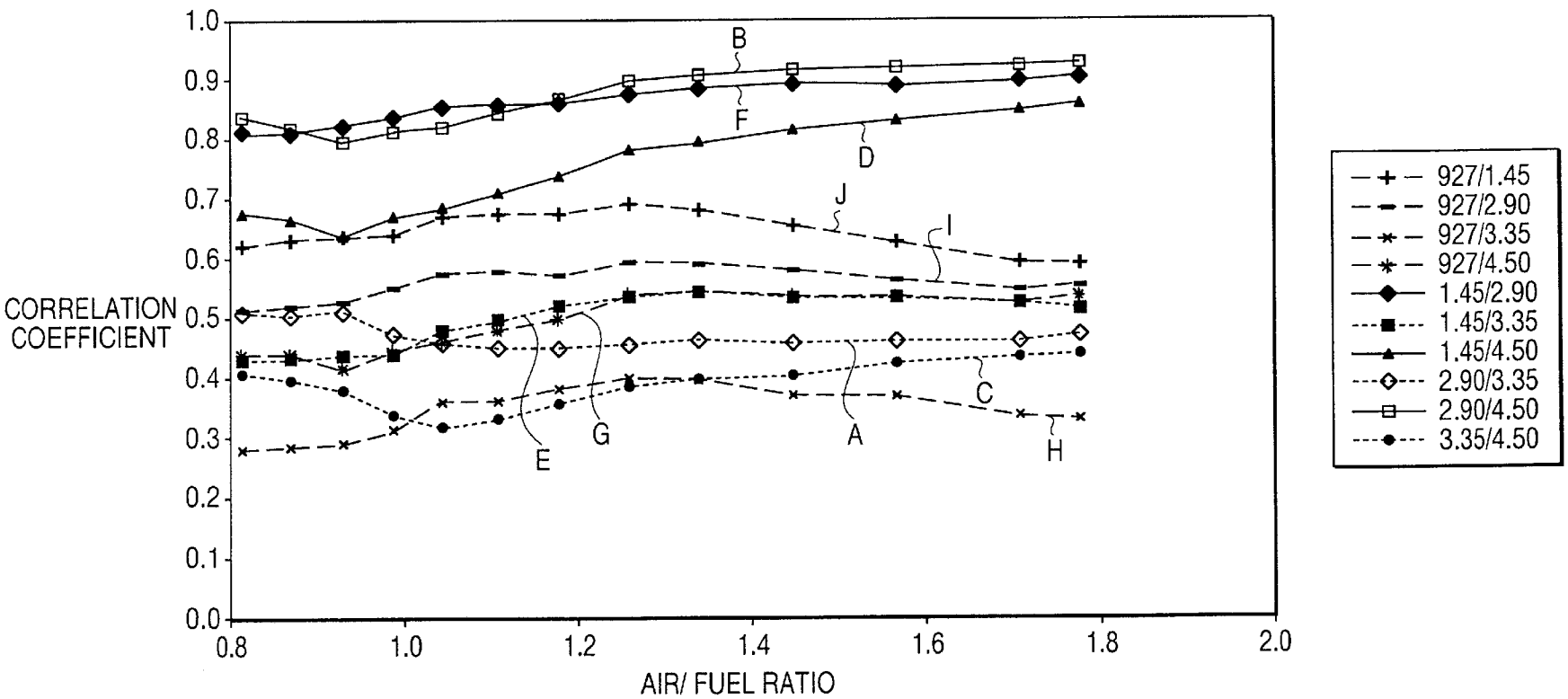

Curve A in FIG. 8, in contrast, shows how the cross-correlation coefficient between the detection signal at 2.9 $\mu$m (sensor 6), corresponding to the $H_2O$ combustion product, and the detection signal at 3.35 $\mu$m, corresponding to the hot fuel in the flame (sensor 8), varies with the air/fuel ratio. The variation is small, and substantially less than the variation shown by curve A in FIG. 5.

Therefore, in one form of the alternative mode of operation, the CPU 24 (FIG. 1) performs the required correlation calculations (i) on the digital data received from the sensors 8 and 10 (corresponding to curve A in FIG. 5) and (ii) on the digital data received from the sensors 6 and 8 (corresponding to curve A in FIG. 8). The two correlation outputs can be compared with each other and also respectively compared with data stored in the memory 26 to determine the air/fuel ratio. Again, by means of the output unit 30 and the valve 34, the CPU can adjust the air/fuel ratio to bring it to the desired value.

Curve B in FIG. 5 shows how the cross-correlation coefficient between the detection signal at 310 nm (the OH transient species, sensor 10) and the detection signal at 2.9 $\mu$m ($H_2O$, sensor 6) varies with the air/fuel ratio. Again, there is a significant variation (generally similar to though not as great as that of curve A in FIG. 5). Therefore, the CPU 24 can produce correlation calculations on the digital data received from sensors 6 and 10 to supplement the correlation calculations specified above on the data received from the other two pairs of sensors. In this second mode of operation, it is also not essential that the sensors 6, 8 and 10 be responsive to radiation in the three wavelengths specified above with reference to FIG. 1. Thus, sensor 6 could instead be arranged to be responsive to emission corresponding to a product of combustion at a different wavelength from 2.9

μm; for example, $H_2O$ at 927 nm or at 1.45 μm, or $CO_2$ at 4.5 μm. Sensor 8 could be arranged to be responsive to emission from a product of combustion, instead of to emission from the hot fuel in the flame. Obviously, though, if it were responsive to the emission corresponding to a product of combustion, this would be at a different wavelength from the wavelength to which sensor 6 is responsive. Sensor 10 could be arranged to be responsive to radiation from some other transient species such as those mentioned earlier: CH at about 431 nm and $C_2$ at about 517 nm, for example.

By way of example, curves C, D and E in FIG. 5 show the correlation coefficient between the output at 310 nm (in each case) on the one hand and the outputs at 1.45 μm ($H_2O$ combustion product), 4.5 μm ($CO_2$ combustion product) and 927 nm ($H_2O$ combustion product) respectively on the other hand. Again, these curves all show significant variation with air/fuel ratio, though somewhat less than for curve A in FIG. 5.

Figure 6:
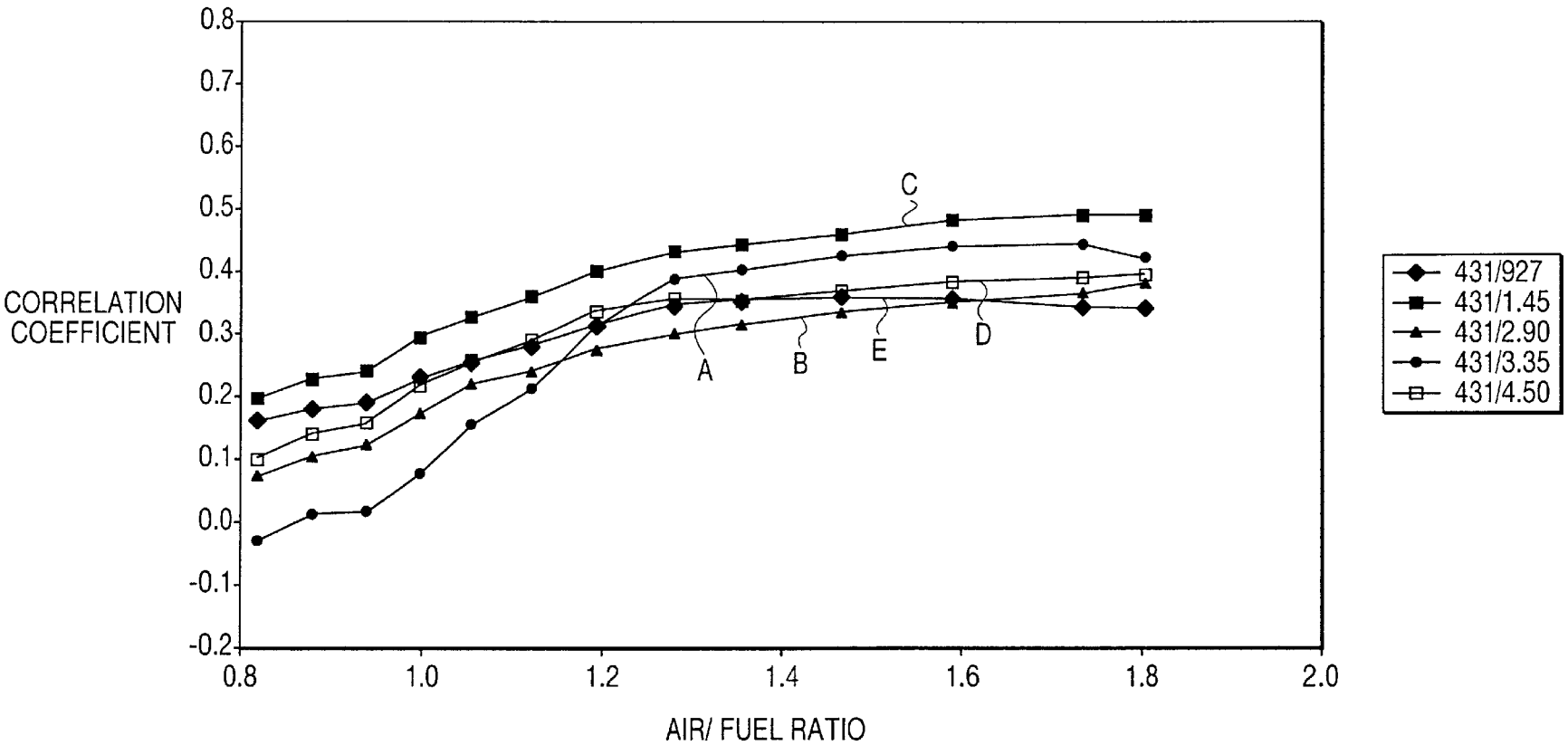

In FIG. 6, the correlation coefficients between the outputs corresponding to the CH transient species at 431 nm on the one hand and the outputs at five different non-transient species on the other hand are shown respectively in curves A, B, C, D and E. In curve A, the non-transient species is the hot fuel at 3.35 μm, in curve B it is $H_2O$ at 2.9 μm, in curve C it is $H_2O$ again but at 1.45 μm, in curve D it is $CO_2$ at 4.5 μm, and in curve E it is $H_2O$ again but at 927 nm. Again, these curves all show significant variation with air/fuel ratio, though somewhat less than for curve A in FIG. 5.

Figure 7:
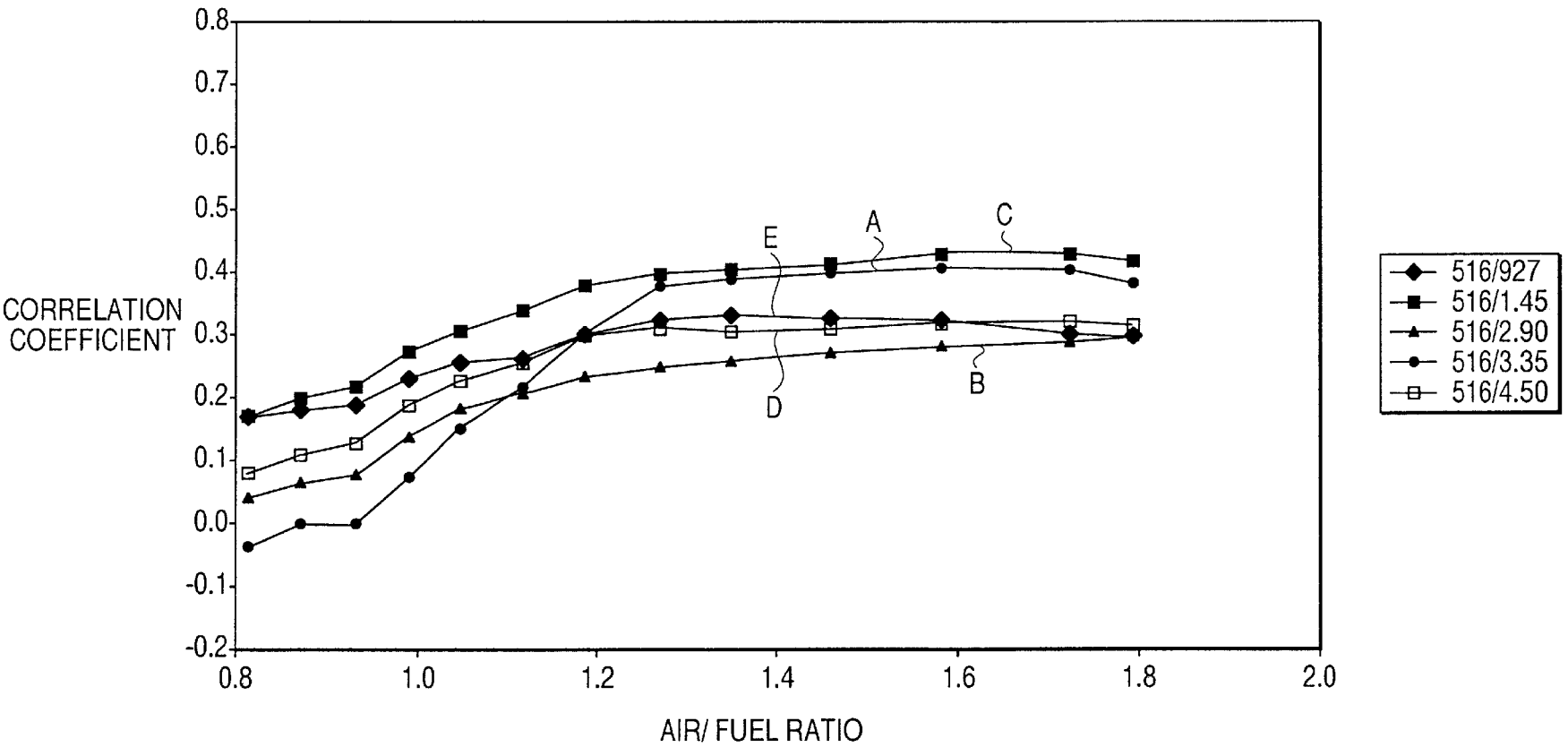

In FIG. 7, the correlation coefficients between the outputs corresponding to the $C_2$ transient species at 516 nm on the one hand and the outputs at five different non-transient species on the other hand are shown respectively in curves A, B, C, D and E. In curve A, the non-transient species is the hot fuel at 3.35 μm, in curve B it is $H_2O$ at 2.9 μm, in curve C it is $H_2O$ again but at 1.45 μm, in curve D it is $CO_2$ at 4.5 μm, and in curve E it is $H_2O$ again but at 927 nm. Again, these curves all show significant variation with air/fuel ratio, though somewhat less than for curve A in FIG. 5.

Referring again to FIG. 8, curves B to J show the correlation coefficients between the outputs corresponding to different pairs of non-transient species as follows:

(i) Curve B: this shows the correlation coefficient between the output corresponding to $H_2O$ at 2.9 μm and the output corresponding to $CO_2$ at 4.5 μm;

(ii) Curve C: this shows the correlation coefficient between the output corresponding to the hot fuel at 3.35 μm and the output corresponding to $CO_2$ at 4.5 μm;

(iii) Curves D, E and F: these show the correlation coefficients between, in each case, the output corresponding to $H_2O$ at 1.45 μm on the one hand and the outputs corresponding to $CO_2$ at 4.5 μm (curve D), hot fuel at 3.35 μm (curve E), and $H_2O$ at 2.9 μm (curve F) respectively on the other hand;

(iv) Curves G, H, I and J: these show the correlation coefficients between, in each case, the output corresponding to $H_2O$ at 927 μm on the one hand and the outputs corresponding to $CO_2$ at 4.5 μm (curve G), the hot fuel at 3.35 μm (curve H), $H_2O$ at 2.9 μm (curve I), and $H_2O$ at 1.45 μm (curve J) respectively on the other hand.

FIG. 8 shows that curves B to J are generally similar in shape to curve A in FIG. 8: the variation of each correlation coefficient with the air/fuel ratio is small.

Thus, a comparison of the curves shown in FIGS. 5, 6 and 7 on the one hand with the curves shown in FIG. 8 on the other shows how the apparatus of FIG. 1 could be modified by making the sensors 6, 8 and 10 sensitive to radiation in the appropriate narrow wavelength bands.

The apparatus may be set up so as to operate simultaneously or sequentially in the two different modes (the first mode in which it takes the ratio of the outputs in a particular frequency band from each detector signal and the second mode in which it measures the correlation coefficients). The result will be to produce two or more estimates of the combustion conditions represented by the air/fuel ratio relative to stoichiometric. The CPU could then be arranged to make a weighted judgment between the estimates in order to control the output unit 30 and the valve unit 34. For example, a suitable artificial intelligence means could be used, such as an expert system, by using fuzzy or conventional logical rules, or by means of an artificial neural network.

In all the embodiments disclosed, therefore, the emission of radiation in a narrow wavelength band corresponding to a transient species that exists only for a short time within the combustion region is compared with the emission in at least one narrow wavelength band corresponding to the hot hydrocarbon fuel in the flame or to a product of combustion to produce an output varying significantly with the air/fuel ratio. Advantageously, and as described, the emission of radiation in wavelength bands respectively corresponding to non-transient species, such as different products of combustion or a product of combustion and the fuel, can be also compared to produce an output varying only slightly with the air/fuel ratio, in order to improve the discrimination process by contrasting the outputs respectively produced with and without the use of the emission due to the transient species. However, if desired, the comparison involving the two non-transient species may be omitted.

If desired, two of the sensors could be responsive to radiation in wavelength bands corresponding to different transient species, with the third responsive to radiation in a wavelength band corresponding to a non-transient species. The emission corresponding to each of the transient species could then be compared with the emission corresponding to the non-transient species. Clearly, more than three sensors could be used to provide further sensitivity of discrimination with at least one being responsive to radiation in a wavelength corresponding to a transient species.

What is claimed is:

1. Apparatus for monitoring a hydrocarbon flame, comprising a first detector responsive to electromagnetic radiation emitted by the flame in a first wavelength corresponding to a transient species existing for only a short time within the combustion region of the flame to produce a first detection signal, said transient species being selected from the group consisting of OH, CH, and $C_2$, a second detector responsive to electromagnetic radiation emitted by the flame in a second wavelength corresponding to a non-transient species in the combustion region to produce a second detection signal, said non-transient species being selected from the group consisting of hot hydrocarbon fuel, $H_2O$, and $CO_2$, a third detector responsive to electromagnetic radiation emitted by the flame in a third wavelength which corresponds to a second non-transient species and is different from the wavelength corresponding to said first-mentioned non-transient species whereby to produce a third detection signal, a processor responsive to the first and second detection signals to produce a first comparison signal and responsive to the second and third detection signals and to one of the first and second detection signals to produce a second comparison signal, and an output unit responsive to the first and second comparison signals to produce an output signal in dependence on the two comparison signals and dependent on the air/fuel ration in the flame.

2. Apparatus according to claim 1, in which the second non-transient species is selected from (a) the hot hydrocarbon fuel in the flame with the third wavelength being about 3.35 $\mu$m, (b) $H_2O$ with the third wavelength being about 927 nm, (c) $H_2O$ with the third wavelength being about 1.45$\mu$ (d) $H_2O$ with the third wavelength being about 2.9 $\mu$m, and (e) $CO_2$ with the third wavelength being about 4.5 $\mu$m.

3. Apparatus according to claim 1, in which the output unit is also responsive to stored data.

4. A method for monitoring a hydrocarbon flame, comprising the steps of detecting electromagnetic radiation emitted by the flame in a first wavelength corresponding to a transient species existing for only a short time within the combustion region of the flame to produce a first detection signal, said transient species being selected from the group consisting of OH, CH, and $C_2$, detecting radiation emitted by the flame in a second wavelength corresponding to a non-transient species in the combustion region to produce a second detection signal, said non-transient species being selected from the group consisting of hot hydrocarbon fuel, $H_2O$, and $CO_2$, detecting electromagnetic radiation emitted by the flame in a third wavelength which corresponds to a second non-transient species and is different from the wavelength corresponding to the first non-transient species whereby to produce a third detection signal, comparing said first and second detection signals to produce a first comparison signals, comparing the third detection signal with one of the first and second detection signals to produce a second comparison signal, and producing an output signal in dependence upon the two comparison signals and dependent upon the air/fuel ratio in the flame.

5. A method according to claim 4, in which the second non-transient species is selected from (a) the hot hydrocarbon fuel in the flame with the third wavelength being about 3.35 $\mu$m, (b) $H_2O$ with the third wavelength being about 927 nm, (c) $H_2O$ with the third wavelength being about 1.45 $\mu$m, (d) $H_2O$ with the third wavelength being about 2.9 $\mu$m, and (e) $CO_2$ with the third wavelength being about 4.5 $\mu$m.

6. A method according to claim 4, in which the step of producing the output signal includes the step of responding to stored data.

* * * * *